US008322543B2

(12) United States Patent
Gelardi et al.

(10) Patent No.: US 8,322,543 B2
(45) Date of Patent: Dec. 4, 2012

(54) PRODUCT DISPENSING APPARATUS AND SYSTEM

(75) Inventors: John Gelardi, Midlothian, VA (US); Aaron L. Bates, Moseley, VA (US); Laurel Thomas, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 228 days.

(21) Appl. No.: 12/890,631

(22) Filed: Sep. 25, 2010

(65) Prior Publication Data

US 2012/0018391 A1 Jan. 26, 2012

Related U.S. Application Data

(60) Provisional application No. 61/400,172, filed on Jul. 23, 2010.

(51) Int. Cl.
*A47F 1/04* (2006.01)
*A47F 7/00* (2006.01)

(52) U.S. Cl. ..... 211/59.2

(58) Field of Classification Search ..... 211/59.2, 211/59.3, 73, 49.1; 221/64, 65, 186, 197, 221/287, 191, 198, 17, 31; 206/817; 312/35, 312/60, 72, 42, 45; 414/412; 229/204, 122.2; 83/946, 856; 53/381.2
See application file for complete search history.

(56) References Cited

U.S. PATENT DOCUMENTS 902,347 A 10/1908 Tillinghast
1,291,420 A 1/1919 Cough
1,383,318 A 7/1921 McCormick
1,393,964 A 10/1921 Potts et al.
1,753,957 A 4/1930 Washburn
1,824,937 A 9/1931 Trouth
1,898,056 A 2/1933 Johnson
1,919,907 A 7/1933 Robinson
1,932,225 A 10/1933 Minter
1,941,458 A 2/1934 Bens
1,985,739 A 12/1934 Murray
2,078,599 A 4/1937 McCauley
(Continued)

FOREIGN PATENT DOCUMENTS

GB 2190906 12/1987
(Continued)

OTHER PUBLICATIONS

International Search Report and Written Opinion issued in PCT/US2010/057020 (Mar. 8, 2011).
International Search Report and Written Opinion issued in PCT/US2010/057221 (Mar. 4, 2011).

*Primary Examiner* — Jennifer E. Novosad
(74) *Attorney, Agent, or Firm* — Walters & Wasylyna, LLC

(57) ABSTRACT

A product dispenser including a frame having a first side wall, a second side wall laterally opposed from the first side wall, a lower support surface positioned between the first and second side walls and having a front end longitudinally spaced from a rear end, the rear end being elevated relative to the front, and an upper support surface positioned between the first and second side walls and spaced apart from the lower support surface, the upper support surface having a front end longitudinally spaced from a rear end, the front end being elevated relative to the rear, and a rib connected to the upper support surface and protruding outward from a plane defined by the upper support surface in a direction away from the lower support surface.

11 Claims, 3 Drawing Sheets

U.S. PATENT DOCUMENTS 2,110,194 A 3/1938 Blier
2,263,353 A 11/1941 Eidam
2,291,187 A 7/1942 Johnson
2,382,191 A 7/1944 Weichselbaum
2,536,421 A 2/1951 Burhans
2,573,381 A 10/1951 Arnold
2,574,087 A 11/1951 Burhans
2,595,122 A 4/1952 Burhans
2,784,871 A 3/1957 Gabrielsen
2,795,845 A 6/1957 Shimer
2,818,978 A 1/1958 Post
2,826,471 A 3/1958 Fonda
2,831,591 A 4/1958 Morton
2,888,145 A 5/1959 Knott et al.
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A * 4/1965 Ellis et al. ..... 312/45
3,184,104 A 5/1965 De Domenico et al.
3,203,554 A * 8/1965 Pendergrast, Jr. et al. ... 211/59.2
3,204,335 A 9/1965 Hughes
3,288,544 A 11/1966 Knecht
3,300,115 A 1/1967 Schauer
3,304,141 A 2/1967 Rogers
3,318,455 A 5/1967 Takahashi
3,335,940 A 8/1967 Dykes
3,340,790 A 9/1967 Simjian
3,348,738 A 10/1967 Hertlein
3,392,901 A 7/1968 Krzyzanowski
3,393,808 A 7/1968 Chirchill
3,501,016 A 3/1970 Eaton
3,763,557 A 10/1973 Sewell
3,784,022 A 1/1974 Beesley, Jr.
3,799,409 A * 3/1974 Goerke ..... 222/561
3,922,778 A 12/1975 Aalpoel
3,923,159 A 12/1975 Taylor et al.
3,972,454 A 8/1976 Croley
4,105,126 A 8/1978 Deffner et al.
4,205,440 A 6/1980 Morgan
4,260,072 A 4/1981 Quasarano
4,382,526 A 5/1983 Stone
4,396,143 A 8/1983 Killy
4,435,026 A 3/1984 Johnson
4,467,524 A 8/1984 Ruff et al.
4,576,272 A 3/1986 Morgan, Jr.
4,598,828 A 7/1986 Young et al.
4,729,480 A 3/1988 Groover et al.
4,744,489 A 5/1988 Binder et al.
4,834,263 A 5/1989 Becze
4,869,395 A 9/1989 Rubbmark
4,911,309 A 3/1990 Stefan
4,915,571 A * 4/1990 Toshihiko et al. ..... 414/414
4,923,070 A 5/1990 Jackle et al.
4,997,106 A 3/1991 Rockola
4,998,628 A 3/1991 Ross
5,033,348 A 7/1991 Walsh
5,080,256 A 1/1992 Rockola
5,101,703 A 4/1992 Tanaka et al.
5,167,345 A 12/1992 Bleeker
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,894,942 A 4/1999 Miyashita et al.
5,992,286 A 11/1999 Boole
5,992,652 A 11/1999 Springs
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,637,604 B1 10/2003 Jay
6,802,433 B2 10/2004 Leykin
6,991,116 B2 1/2006 Johnson et al.
7,207,447 B2 4/2007 Medcalf et al.
7,303,095 B2 12/2007 Nagelski et al.
7,546,973 B2 6/2009 Budz et al.
7,584,854 B2 9/2009 Chandaria
D604,972 S 12/2009 Henry et al.
7,665,618 B2 2/2010 Jay et al.
7,681,745 B2 3/2010 Richter
7,810,672 B1 10/2010 Mason et al.
7,823,733 B2 11/2010 Futori
7,850,015 B1 12/2010 Mason
7,913,860 B2 3/2011 Merl
7,918,365 B2 4/2011 White et al.
7,922,437 B1 4/2011 Loftin et al.
7,992,747 B2 * 8/2011 Bauer ..... 221/197
7,992,748 B2 * 8/2011 Lawrence ..... 221/203
8,028,855 B2 10/2011 White et al.
2002/0043509 A1 4/2002 Lajeunesse et al.
2004/0011751 A1 1/2004 Johnson et al.
2004/0262326 A1 12/2004 Christensen
2005/0127015 A1 6/2005 Medcalf et al.
2005/0207877 A1 9/2005 Haverdink et al.
2006/0081692 A1 4/2006 Stewart et al.
2006/0237384 A1 10/2006 Neumann et al.
2006/0278591 A1 12/2006 Tippets et al.
2008/0245813 A1 10/2008 Johnson et al.
2009/0212066 A1 8/2009 Bauer
2009/0266776 A1 10/2009 Johnson
2010/0032391 A1 2/2010 Schneider et al.
2011/0121010 A1 5/2011 Loftin et al.
2011/0121011 A1 5/2011 Gelardi et al.

FOREIGN PATENT DOCUMENTS

GB 2303624 2/1997
JP 03105494 A 5/1991
JP 03133737 A 6/1991
JP 03198192 A 8/1991
JP 03273469 A 12/1991
JP 03273470 A 12/1991
JP 03273471 A 12/1991
JP 03273472 A 12/1991
JP 03273474 12/1991
JP 03273476 A 12/1991
JP 03273477 A 12/1991
JP 03273480 A 12/1991
JP 03273482 A 12/1991
JP 03273483 A 12/1991
JP 04086985 A 3/1992
JP 04115392 A 4/1992
JP 04137194 A 5/1992
JP 05004640 A 1/1993
JP 05174239 A 7/1993
JP 05346984 A 12/1993
JP 08161611 A 6/1996
JP 09027066 A 1/1997
JP 09102065 A 4/1997
JP 09282537 A 10/1997
JP 09311971 A 12/1997
JP 10269421 A 10/1998
JP 11011471 A 1/1999
JP 11171264 A 6/1999
JP 11191175 A 7/1999
JP 11328513 A 11/1999
JP 2001072076 A 3/2001

| | | | |
|---|---|---|---|
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 2004113808 | | 12/2004 |
| WO | WO 2009138538 | | 11/2009 |

* cited by examiner

PRODUCT DISPENSING APPARATUS AND SYSTEM

PRIORITY

This application claims priority from U.S. Provisional Patent Application No. 61/400,172 filed on Jul. 23, 2010, the entire contents of which are incorporated herein by reference.

FIELD

This application relates to apparatus and systems for dispensing products from loaded containers and, more particularly, to apparatus and systems configured to dispense products having asymmetrical side profiles from loaded containers.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model are being developed in an effort to improve operating efficiency. For example, U.S. patent application Ser. No. 12/777,444 filed on May 11, 2010, the entire contents of which are incorporated herein by reference, discloses a new system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that product rolls from the container and down to the product display area of the frame under the force of gravity.

Many products are not symmetrical along their rolling axis and, therefore, do not roll in a straight line. For example, the canned food product 10 shown in FIG. 1 includes a circumferential side wall 12 having a first end 14 and a second end 16, wherein the second end 16 is sealed with a chime 18. Therefore, the second end 16 of the canned food product 10 extends further outward from the rolling axis A (by a distance D) than the first end 14 (i.e., the second end 16 has a greater radius than the first end 14), resulting in the canned food product 10 rolling in a nonlinear path B.

Unfortunately, the dispensing systems mentioned above have been known to jam when a dispensed product fails to travel in a straight line. Such jams may occur within the container or as the product transitions from the container to the frame, thereby inhibiting the consumer's ability to retrieve the product.

Accordingly, those skilled in the art continue with research and development efforts directed to apparatus and systems for dispensing products from packaging containers.

SUMMARY

In one aspect, the disclosed product dispenser may include a frame having a first side wall, a second side wall laterally opposed from the first side wall, a lower support surface positioned between the first and second side walls and having a front end longitudinally spaced from a rear end, the rear end being elevated relative to the front, and an upper support surface positioned between the first and second side walls and spaced apart from the lower support surface, the upper support surface having a front end longitudinally spaced from a rear end, the front end being elevated relative to the rear, and a rib connected to the upper support surface and protruding outward from a plane defined by the upper support surface in a direction away from the lower support surface.

In another aspect, the disclosed product dispensing system may include a dispenser having a first side wall, a second side wall opposed from the first side wall, a lower support surface positioned between the first and second side walls and having a front end and a rear end, the rear end of the lower support surface being elevated relative to the front end of the lower support surface, an upper support surface positioned between the first and second side walls and spaced apart from the lower support surface, the upper support surface having a front end and a rear end, the front end of the upper support surface being elevated relative to the rear end of the upper support surface, and a rib connected to the upper support surface and protruding outward from a plane defined by the upper support surface, and a container supported on the upper support surface, the container including walls that define an internal volume and a multiple products positioned in the internal volume, wherein at least one wall of the container is engaged with, and deflected by, the rib.

In another aspect, the disclosed product dispensing system may include a dispenser including a first side wall, a second side wall opposed from the first side wall; a lower support surface positioned between the first and second side walls and having a front end and a rear end, the rear end being elevated relative to the front end, an upper support surface positioned between the first and second side walls and spaced apart from the lower support surface, the upper support surface having a front end and a rear end, the front end being elevated relative to the rear end, and an elongated rib connected to the upper support surface and protruding outward from a plane defined by the upper support surface in a direction away from the lower support surface, and a container supported on the upper support surface and including a plurality of walls that define an internal volume and a plurality of products positioned in the internal volume, at least one the walls including a plurality of pre-formed fold lines, wherein that wall is engaged with the rib and deflected into the internal volume along the pre-formed fold lines.

In yet another aspect, disclosed is a method for loading a container onto a dispenser such that the dispenser beneficially interacts with the container to urge the products in the container to roll in a substantially straight line.

Other aspects of the disclosed product dispensing apparatus and system will become apparent from the following detailed description, the accompanying drawings and the appended claims.

DETAILED DESCRIPTION

Figure 1:
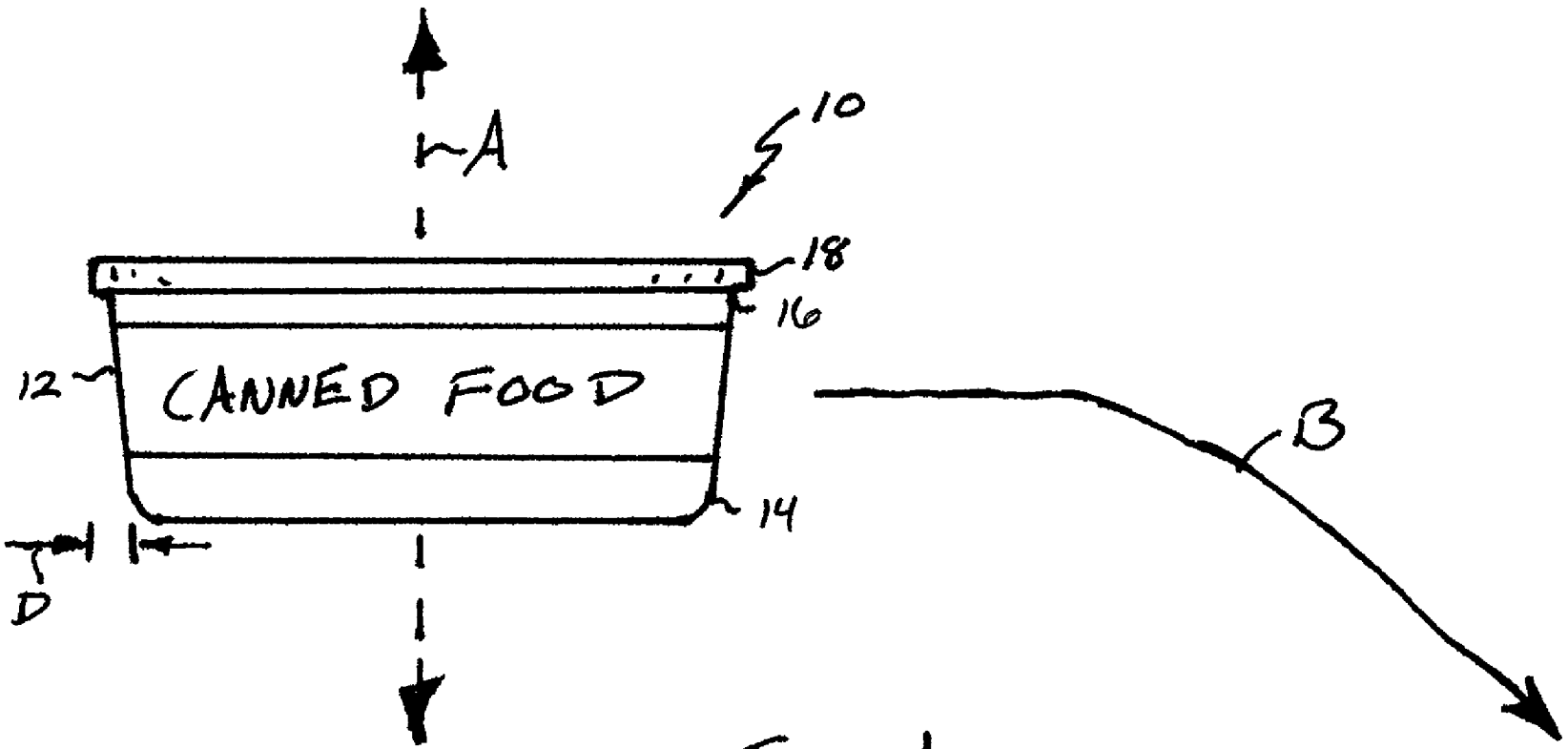
FIG. 1 (Prior Art)
FIG. 1 is a top plan view of a canned food product rolling about its rolling axis in a nonlinear path.
Figure 2:
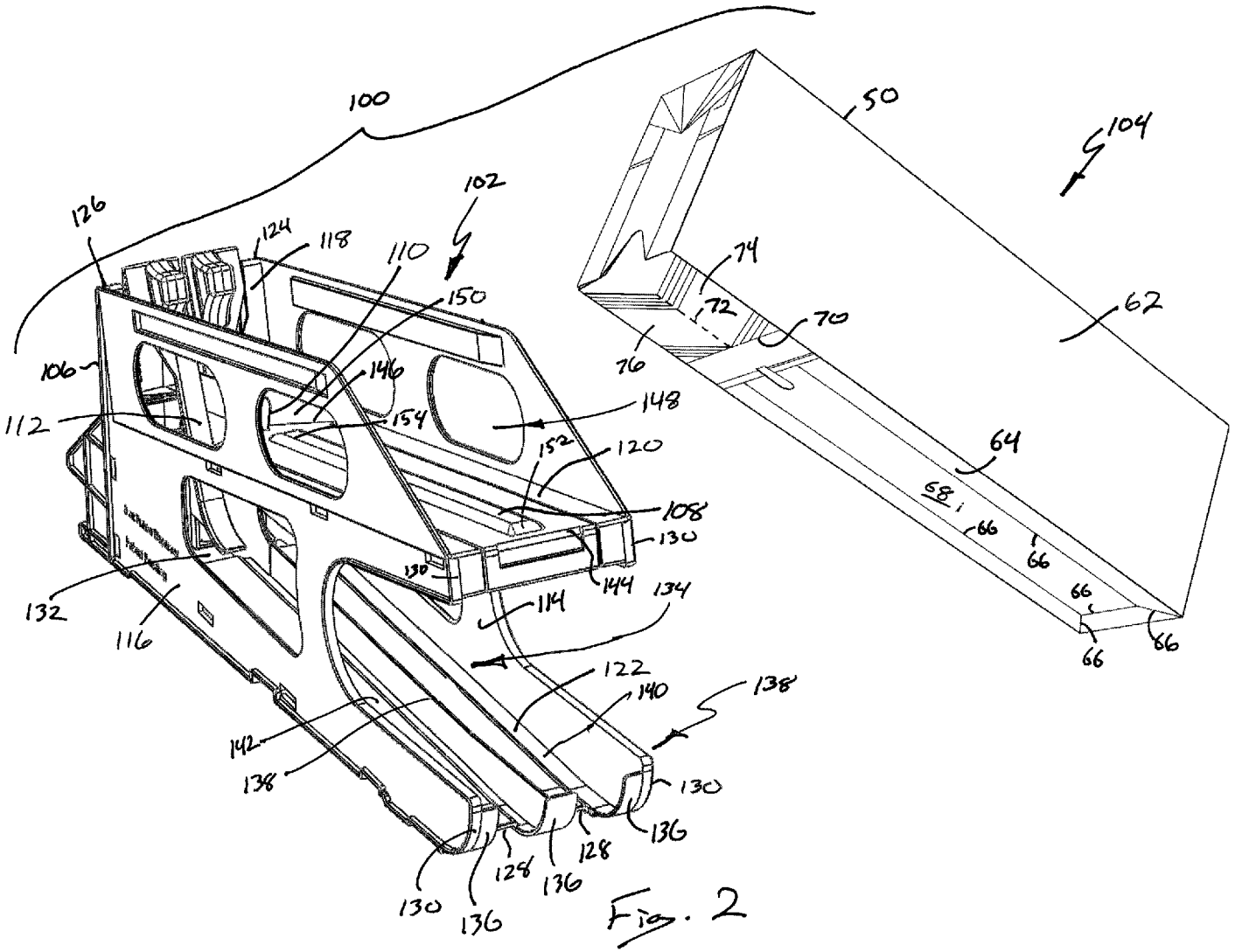
FIG. 2 is a front perspective view of one aspect of the disclosed product dispensing system.
Figure 3:
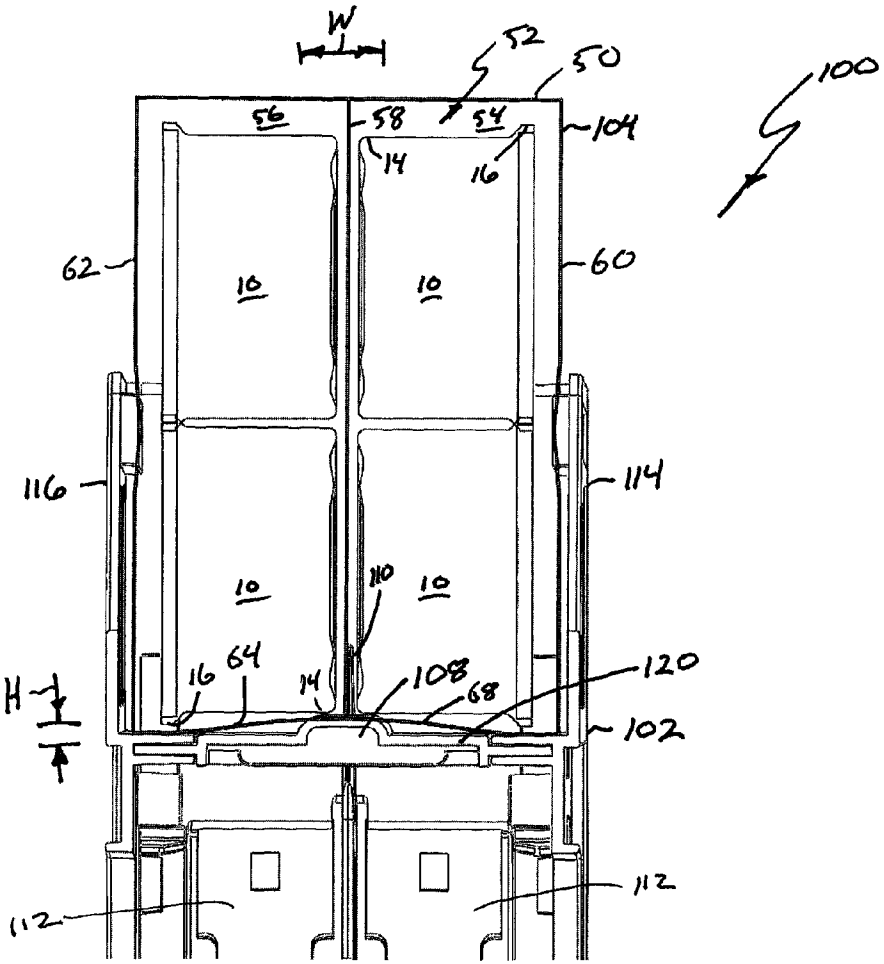
FIG. 3 is a front elevational view, in section, of a portion of the product dispensing system of FIG. 2, shown with the container loaded onto the dispenser.

Referring to FIGS. 2 and 3, one aspect of the disclosed product dispensing system, generally designated 100, may include a dispenser 102 and a container 104. As shown in FIG. 3, the container 104 may include multiple units of product 10, such as the canned food product 10 shown in FIG. 1. The container 104 may be loaded onto the dispenser 102 such that product 10 is released from the container 104 into the dispenser 102, thereby allowing the product 10 to be viewed and retrieved by consumers.

The container 104 may be any container capable of holding product 10 and being used with the disclosed dispenser 102. For example, as shown in FIGS. 2 and 3, the container 104 may be a six-walled paperboard carton 50 having an internal volume 52 divided into a first chamber 54 and a second chamber 56 by a partition panel 58. The first chamber 54 may include two rows of product 10 arranged such that the first ends 14 of the product 10 are in facing alignment with the partition panel 58 and the second ends 16 of the product 10 are in facing alignment with side wall 60. The second chamber 56 may include two rows of product 10 arranged such that the first ends 14 of the product 10 are in facing alignment with the partition panel 58 and the second ends 16 of the product 10 are in facing alignment with side wall 62.

In one particular construction, the container 104 may include a base wall 64 that has been modified to beneficially interact with the disclosed dispenser 102. Specifically, the base wall 64 of the container 104 (i.e., the wall that rests on the dispenser 102) may include pre-formed fold lines 66 that encourage a central portion 68 of the base wall 64 to deflect inward when the container 104 is loaded onto the dispenser 102, as shown in FIG. 3 and discussed in greater detail below.

The dispenser 102 may include a frame 106 for supporting the container 104 and the product 10 in a desired configuration, an elongated rib 108 connected to the frame 106 to interact with the container 104 and the product 10 therein when the container 104 is mounted on the frame 106, and a cutting element 110 for opening the container 104 to release the product 10 from the container 104 to the dispenser 102. Optionally, the dispenser 102 may additionally include one or more guides 112 connected to the frame 106 to guide product 10 exiting the container 104 and entering the dispenser 102. Those skilled in the art will appreciate that the dispenser 102 may include additional components and features without departing from the scope of the present disclosure.

The frame 106 may include a first side wall 114, a second side wall 116, a rear wall 118, an upper support surface 120 and a lower support surface 122. The first side wall 114 may extend generally perpendicularly from a first end 124 of the rear wall 118. The second side wall 116 may extend generally perpendicularly from a second, opposite end 126 of the rear wall 118 such that the second side wall 116 is generally parallel with the first side wall 114.

The lower support surface 122 may extend between the first 114 and second 116 side walls, and may include a front end 128 that extends to the front ends 130 of the side walls 114, 116 and a rear end 132 that extends to the rear wall 118, thereby defining a lower level 134 of the frame 106. The lower support surface 122 may be inclined from the front end 128 to the rear end 132 (i.e., the rear end 132 may be elevated relative to the front end 128) such that product 10 positioned at the rear end 132 of the lower support surface 122 rolls down to the front end 128 of the lower support surface 122 under the force of gravity. As an example, the lower support surface 122 may be inclined at an angle of about 8 degrees.

One or more stops 136 may be positioned proximate (i.e., at or near) the front end 128 of the lower support surface 122 to prevent product 10 from rolling beyond the front end 128 of the lower support surface 122. Therefore, the stops 136 may collect product 10 at the front end 128 of the lower support surface 122, thereby establishing a product display area 138 at the front end 128 of the lower support surface 122.

In one particular implementation, a divider 138 may extend from the front end 128 of the lower support surface 122 to the rear wall 118 to divide the lower level 134 into a first product channel 140 and a second product channel 142. The first product channel 140 may be defined by the lower support surface 122, the first side wall 114 and the divider 138, and may extend from proximate the rear wall 118 to the front end 128 of the lower support surface 122. The second product channel 142 may be defined by the lower support surface 122, the second side wall 116 and the divider 138, and may extend from proximate the rear wall 118 to the front end 128 of the lower support surface 122.

While two product channels 140, 142 are shown and described, those skilled in the art will appreciate that the frame 106 may be constructed to provide only one product channel or more than two product channels, depending on the configuration of product 10 in the container 104, without departing from the scope of the present disclosure.

The upper support surface 120 may extend between the first 114 and second 116 side walls, and may include a front end 144 that extends to the front ends 130 of the side walls 114, 116 and a rear end 146 that extends toward, but not to, the rear wall 118, thereby defining an upper level 148 of the frame 106. The spacing between the rear end 146 of the upper support surface 120 and the rear wall 118 may define an opening 150, which may function as a chute to allow product 10 to move from the upper level 148 to the lower level 134 of the frame 106. The upper support surface 120 may be declined from the front end 144 to the rear end 146 (i.e., the front end 144 is elevated relative to the rear end 146) such that product 10 supported by the upper support surface 120 rolls under the force of gravity down to the rear end 146 of the upper support surface 120, through the opening 150 and, ultimately, to the lower level 134 of the frame 106. As an example, the upper support surface 120 may be declined at an angle of about 8 degrees.

The cutting element 110 may be positioned proximate the rear end 146 of the upper support surface 120 to cut a portion of the container 104 as the container 104 is loaded onto the upper support surface 120. By cutting the container 104 with the cutting element 110, an opening may be formed in the container 104, thereby allowing product 10 to exit the container 104 and roll from the upper level 148 to the lower level 134 and, ultimately, to the product display area 138.

As one example of a deploying method, a user may first form a cut line 70 (FIG. 2) across the base wall 64 of the container 104 prior to loading the container 104 onto the dispenser 102. The cut line 70 may be formed using, for example, a blade or pulling a rip-strip (not shown). Then, the container 104 may be loaded onto the dispenser 102 such that the cutting element 110 cuts the container 104 along perforated line 72. When the perforated line 72 is severed, first and second flaps 74, 76 of the container 104 may open outward, thereby creating an exit opening in the container 104.

The guides 112 may be connected to the rear wall 118 and may extend through the opening 150 from the upper level 148 to the lower level 134. Therefore, when a container 104 containing multiple units of product 10 has been loaded onto the dispenser 102 and opened by way of the cutting element 110, the first guide 112 may function as a first ramp that directs product 10 from the first chamber 54 of the container 104, through the opening 150, and to the first product channel 140, while a second guide 112 may function as a second ramp that directs product 10 from the second chamber 56 of the container 104, through the opening 150, and to the second product channel 142.

The rib 108 may be connected to the upper support surface 120 and may be any elongated protrusion (or series of protrusions) that extends upward from a plane defined by the upper support surface 120. Those skilled in the art will appreciate that "connected" includes constructions where the rib 108 and the upper support surface 120 are integral (i.e., formed as a single monolithic body), as well as constructions where the rib 108 is a separated piece that has been attached to the upper support surface 120, such as with mechanical fasteners (e.g., rivets) and/or adhesives (e.g., an epoxy adhesive). Therefore, existing dispensers may be retrofitted to include a rib 108 connected to the upper support surface 120 without departing from the scope of the present disclosure.

The rib 108 may extend longitudinally along the upper support surface 120 and may include a first end 152 positioned proximate the front end 144 of the upper support surface 120 and a second end 154 positioned proximate the rear end 146 of the upper support surface 120. While a single rib 108 is shown extending continuously from the first end 152 to the second end 154 of the rib 108, those skilled in the art will appreciate that the rib 108 may be comprised of multiple, longitudinally-aligned ribs.

As shown in FIG. 3, the rib 108 may have a maximum height H and a maximum width W, and may be generally centered between the side walls 114, 116 of the frame 106. The height H of the rib 108 may be dictated by the magnitude of the eccentricity of the product 10. The cross-sectional thickness of the base wall 64 of the container 104 may also be a factor in determining the height H of the rib 108. Specifically, the height H may be selected to minimize or eliminate the eccentricity of the product 10 when the container 104 is loaded onto the dispenser 102. For example, the height H of the rib 108 may closely correspond to the difference between the radius of the second end 16 of the product 10 and the radius of the first end 14 of the product 10 (i.e., distance D in FIG. 1).

The width W of the rib 108 may be dictated by, among other things, the size of the products 10 in the container 10 and/or the arrangement of the products 10 in the container 104. For example, as shown in FIG. 3, the width W of the rib 108 may be sufficient to allow the rib 108 to interact with product 10 in both chambers 54, 56 of the container 104, but not so large as to create instability when the products 10 begin to roll in the container 104.

While only one rib 108 is shown and described as being centered between the side walls 114, 116 of the frame 106, those skilled in the art will appreciate that multiple ribs 108 may be provided on the upper support surface 120, and that the lateral location of the rib 108 may depend, for example, on the shape and configuration of the product 10 and/or the arrangement and configuration of the product 10 in the container 104. A single, centered rib 108 is only one non-limiting example, and may be particularly useful with a container 104 having two equally-sized chambers 54, 56.

Accordingly, when the container 104 is loaded onto the dispenser 102, the rib 108 may interact with the container 104 to encourage the products 10 within the container 104 to roll in a substantially straight line. Specifically, the rib 108 may engage the base wall 68 of the container 104 to deflect the base wall 68 (or at least a portion of the base wall 68) inward into the internal volume 52 of the container 104, thereby raising the first ends 14 of the products 10 in the container 104 such that the products 10 roll along the base wall 68 in a substantially straight line. When the container is provided with pre-formed fold lines 66, the deflection of the base wall 68 due to the rib 108 may occur along the pre-formed fold lines 66.

Although various aspects of the disclosed product dispensing apparatus and system have been shown and described, modifications may occur to those skilled in the art upon reading the specification. The present application includes such modifications and is limited only by the scope of the claims.

What is claimed is:

1. A product dispensing system comprising:

a dispenser comprising:

a first side wall;

a second side wall opposed from said first side wall;

a lower support surface positioned between said first and second side walls and having a front end and a rear end;

an upper support surface positioned between said first and second side walls and spaced apart from said lower support surface, said upper support surface having a front end and a rear end; and a rib connected to said upper support surface and protruding outward from a plane defined by said upper support surface; and a container supported on said upper support surface, said container comprising a plurality of walls that define an internal volume and a plurality of products positioned in said internal volume, said container further comprising a partition panel that divides said internal volume into at least a first chamber supporting a first portion of said plurality of products and a second chamber supporting a second portion of said plurality of products, wherein at least one wall of said plurality of walls is engaged with, and deflected by, said rib, and wherein said rib is engaged with said first portion and said second portion.

2. The product dispensing system of claim 1 wherein said deflected wall engages said plurality of products such that said plurality of products roll linearly from said front end of said upper support surface to said rear end of said upper support surface.

3. The product dispensing system of claim 1 wherein said container includes a plurality of pre-formed fold lines.

4. The product dispensing system of claim 3 wherein said deflected wall is deformed along said plurality of pre-formed fold lines.

5. The product dispensing system of claim 1 wherein each product of said plurality of products includes a first portion having a first radius and a second portion having a second radius, said second radius being greater than said first radius.

6. The product dispensing system of claim 5 wherein said rib engages said first radius of said plurality of products.

7. The product dispensing system of claim 6 with the proviso that said rib does not engage said second radius of said plurality of products.

8. The product dispensing system of claim 1 wherein said rear end of said lower support surface is elevated relative to said front end of said lower support surface, and wherein said front end of said upper support surface is elevated relative to said rear end of said upper support surface.

9. A product dispensing system comprising:

a dispenser comprising:

a first side wall;

a second side wall opposed from said first side wall;

a lower support surface positioned between said first and second side walls and having a front end and a rear end;

an upper support surface positioned between said first and second side walls and spaced apart from said lower support surface, said upper support surface having a front end and a rear end; and a rib connected to said upper support surface and protruding outward from a plane defined by said upper support surface; and a container supported on said upper support surface, said container comprising a plurality of walls that define an internal volume and a plurality of products positioned in said internal volume, wherein each product of said plurality of products includes a first portion having a first radius and a second portion having a second radius, said second radius being greater than said first radius, wherein said rib engages said first radius of said plurality of products.

10. The product dispensing system of claim 9 with the proviso that said rib does not engage said second radius of said plurality of products.

11. The product dispensing system of claim 9 wherein at least one wall of said plurality of walls is deflected by said rib.

* * * * *